United States Patent [19]

Kamiya

[11] Patent Number: 4,584,922

[45] Date of Patent: Apr. 29, 1986

[54] ELECTRONIC MUSICAL INSTRUMENT

[75] Inventor: Maki Kamiya, Iwata, Japan

[73] Assignee: Nippon Gakki Seizo Kabushiki Kaisha, Hamamatsu, Japan

[21] Appl. No.: 667,268

[22] Filed: Nov. 1, 1984

[30] Foreign Application Priority Data

Nov. 4, 1983 [JP] Japan ..... 58-208183

[51] Int. Cl.[4] ..... G10H 1/42; G10H 7/00; G10L 5/02

[52] U.S. Cl. ..... 84/1.01; 84/1.03; 84/DIG. 12; 381/51

[58] Field of Search ..... 84/1.01, 1.03, 1.19–1.24, 84/DIG. 12; 381/51–53

[56] References Cited

U.S. PATENT DOCUMENTS 4,527,274 7/1985 Gaynor ..... 84/1.01 X

FOREIGN PATENT DOCUMENTS 58-53351 11/1983 Japan .

*Primary Examiner*—S. J. Witkowski

*Attorney, Agent, or Firm*—Spensley Horn Jubas & Lubitz

[57] ABSTRACT

In an electronic musical instrument, a tone generation designating circuitry provides, upon depression of each playing key, a set of parameter signals designating properties such as pitch and timbre of a tone to be generated and a key-on signal indicating the depression of the key, and in response to these parameter signals and key-on signal, a tone generator generates a vibratory wave signal having the designated tone properties at the designated timing as a tone signal for the depressed key. The tone generation designating circuitry includes a microcomputer to control and perform data processing. There are further provided a first clock pulse generator which generates time frame clock pulses defining consecutive time frames, and a second clock pulse generator which generates pitch clock pulses defining fundamental frequencies of human voice for the respective time frames. In a human voice mode, the microcomputer provides for each time frame a plurality of parameter signals designating a plurality of formant frequencies of a human voice and controls to feed the pitch clock pulses to the tone generators in place of the key-on signals to initialize the respective vibrations at every arrival of the clock pulse. Thus many harmonics exhibiting the designated formant pattern are produced above the designated fundamental, and such pattern is varied with time to simulate speech by human voices.

8 Claims, 4 Drawing Figures

ELECTRONIC MUSICAL INSTRUMENT

BACKGROUND OF THE INVENTION

1. Field of the Invention

This invention relates to an electronic musical instrument made to generate vibrating wave signals simulating human voices.

2. Description of the Prior Art

It is generally known that there are fixed formants in human voices issued by a person. The fixed formants appear as the sound waves derived from the vibrations of the vocal chord are modified by the resonance characteristics of a vocal path including a trachea, oral cavity and nasal cavity, thereby forming a particular tone color.

In a conventional musical instrument, there has been a system wherein fixed analog filters are used to realize fixed formants of human voices. (For example, Japanese Utility Model Laid-Open No. 38356/1980) This system requires analog filters having a considerably high Q to realize the fixed formants and becomes so expensive as to make it hard to realize in respect of the price.

SUMMARY OF THE INVENTION

A primary object of the present invention is to provide an electronic musical instrument made to generate vibrating wave signals simulating human voices with a simple construction and at a low cost by utilizing tone generators equipped in the electronic musical instrument.

According to the present invention, this object is attained by an electronic musical instrument characterized by comprising tone generation designating means generating in response to depression of playing keys a plurality of sets of parameter signals, each set per each key, designating the properties of tones to be generated respectively and a plurality of key-on signals each representing the depression of each key, vibrating wave generating means connected to said tone generation designating means and generating a plurality of vibrating wave signals having tone properties including frequencies designated by said respective parameter signals and having a wave shape starting from a predetermined initial phase point responsive to said respective key-on signals, a first clock pulse generator connected to said tone generation designating means and generating time frame clock pulses (timing pulses) of a predetermined period defining consecutive time frames, a second clock pulse generator connected to said tone generation designating means and generating pitch clock pulses (timing pulses) of predetermined periods for the respective time frames respectively defining fundamental pitches of human voice to be produced, and controlling means connected to said tone generation designating means and said vibrating wave generating means and controlling said tone generation designating means so as to generate for said respective time frames a plurality of parameter signals designating a plurality of frequencies corresponding to a plurality of formant frequencies of human voices to be produced and rendering said pitch clock pulses to be fed to said vibrating wave generating means in place of said key-on signals, said vibrating wave generating means thereby generating vibrating wave signals simulating human voices.

According to the present invention, a conventional electronic musical instrument formed of tone generation designating means and vibrating wave generating means is provided with a first clock pulse generator generating time frame clock pulses, a second clock pulse generator generating pitch clock pulses and controlling means so as to generate vibrating wave signals simulating human voices at the time of human voice generation mode. Therefore, an electronic musical instrument capable of generating vibrating wave signals simulating human voices is realized without the need of using expensive analog filters, but with a simple construction and at a low cost.

This and other objects of the present invention will become more apparent during the course of the following detailed description and appended claims.

DESCRIPTION OF THE PREFERRED EMBODIMENTS

Figure 1:
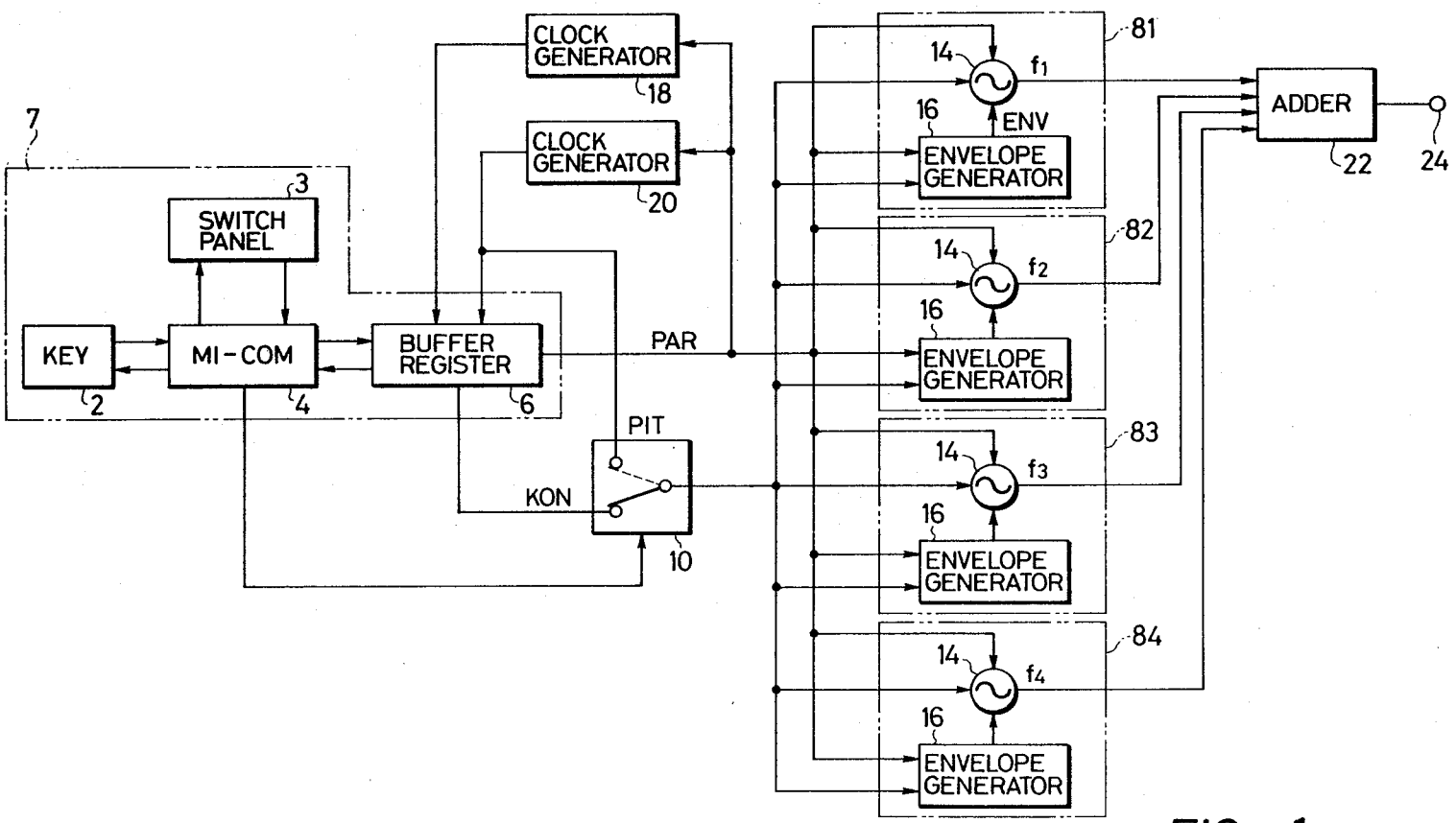
FIG. 1 is a block diagram showing an embodiment of the electronic musical instrument according to the present invention.

In FIG. 1 showing an embodiment of the electronic musical instrument of the present invention, the respective playing keys as depressed on a keyboard 2 and the respective control switches as operated on a switch panel 3 are detected by a microcomputer 4 (which shall be called a micom 4 hereinafter), the micom 4 generates a plurality of sets of parameter signals PAR designating the properties (such as tone pitch, tone color and envelope shape) of respective tones to be generated in response to the respective operations of the keys and the switches and further generates a plurality of key-on signals KON representing the respective depressed keys, and these signals are delivered out through a buffer registor 6. The keyboard 2, the switch panel 3, micom 4 and buffer register 6 constitute the tone generation designating means 7.

The plurality of sets of parameter signals PAR derived from the buffer register 6 are applied respectively to a plurality of vibrating wave generators 81, 82, 83 and 84. The respective vibrating wave generators 81 to 84 generate respectively vibrating wave signals. The respective vibrating wave signals have frequencies $f_1$ to $f_4$ designated by the respective parameter signals PAR and other tone properties (such as the tone colors and envelope shapes) and starting from a predetermined initial phase point (for example, a zero cross point) in response to the key-on signal KON from the buffer register 6 given through a transfer switch 10. In the case of this example, the four vibrating wave generators 81 to 84 may be for the generation of separate tone signals corresponding to four keys on the keyboard 2 or may be for the synthesis of one tone signal corresponding to one key on the keyboard 2 with four vibrating waves (partials).

Wave oscillators 14 and envelope generators 16 are individually provided in the respective vibrating wave generators 81 to 82.

Figure 2:
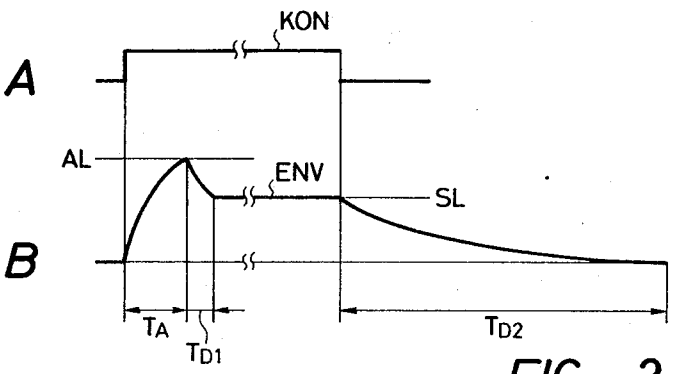
FIG. 2 is a waveform chart showing a key-on signal and an envelope signal.

Not only the above mentioned parameter signals PAR from the buffer register 6 and key-on signals KON from the transfer switch 10 but also envelope signals ENV from the envelope generators 16 are given to the wave oscillators 14. FIG. 2A shows the above mentioned key-on signal KON. FIG. 2B shows an envelope signal ENV generated in response to the key-on signal KON. Symbol $T_A$ denotes an attack time (for example 10 ms to several 10 ms), $TD_1$ denotes a first decay time (for example, several ms), $TD_2$ denotes a second decay time (for example, 100 ms to several 100 ms), AL denotes an attack level and SL denotes a sustain level decayed by about 4 to 6 dB from AL.

The first clock pulse generator 18 will generate rhythm clock pulses for automatic rhythms at the time of an ordinary musical tone generating mode, but will generate time frame clock pulses of a predetermined period defining consecutive time frames (time segments) at the time of the human voice generating mode. On the other hand, the second clock pulse generator 20 will generate clock pulses for key scanning at the time of the musical tone generating mode, but will generate voice pitch clock pulses of predetermined periods for the respective time frames respectively defining fundamental voice pitches at the time of the human voice generating mode. The respective modes are selected by the operation of the switch panel 3. In response to the selection, the micom 4 controls the clock pulse generators 18 and 20 through the buffer registor 6. The respective clock pulses thus generated by said clock pulse generators 18 and 20 are received by the micom 4 through the buffer register 6 and are utilized for predetermined processing corresponding to the modes.

Also, the transfer switch 10 is switched and controlled by the control output of the micom 4 in response to the selection of the above mentioned modes. That is to say, in the human voice generating mode, a plurality of parameter signals PAR designating a plurality of frequencies corresponding to a plurality of formant frequencies of the human voices are delivered out in the respective time frames, the above mentioned pitch clock pulses PIT are delivered out in place of the above mentioned key-on signals KON via the transfer switch and both signals are fed to the respective vibrating wave generators 81 to 84.

According to such construction, at the time of the human voice generating mode, the respective wave oscillators 14 will generate frequency signals designated by the respective parameter signals PAR and will repeatedly start the signals forcibly (by resetting) from the initial phase point synchronous with the respective pitch clock pulses PIT and therefore the respective frequency signals will become partial tone signals of a frequency spectrum pattern having the frequency of the pitch clock pulses PIT as the fundamental frequency and having formant centers at the respective frequencies of the respective frequency signals.

The outputs generated by these respective vibrating wave generators 81 to 84 are supplied to the adder 22, are synthesized as voice signals and are outputted at the output terminal 24.

At this time, the first clock pulse generator 18 will generate predetermined time frame clock pulses and will define consecutive time frames. These time frames are just like respective picture frames of a movie film, and are time segments for successively representing time wise variations. For the respective segmented time frames, the micom 4 gives parameter signals PAR to the respective wave oscillators 14 and envelope generators 16 through the buffer register 6, and also designates for the second clock pulse generator 20 fundamental voice pitches to be used in the time segments by means of the parameter signals PAR. Thereby, the second clock pulse generator 20 generates pitch clock signals PIT of a predetermined period for the time segments, gives them to the respective wave oscillators 14 and envelope generators 16 and resets respective frequency signals generated there to the initial phase point. Thus, human voice signal for the time segment is generated. These human voice signals are connected one after another in respect of time to be heard as words.

An operation example for generating human voices is shown in the following. This example shows frequency $f_P$ of the pitch clock pulse and frequencies $f_1$, $f_2$, $f_3$ and $f_4$ and amplitude coefficients $a_1$, $a_2$, $a_3$ and $a_4$ of four vibration waves in the respective time frames over 20 time frames each of a period of 20 ms.

| Time frame No. | $f_p$ [Hz] | $f_1$, $f_2$, $f_3$, $f_4$ [Hz] | $a_1$, $a_2$, $a_3$, $a_4$ |
|---|---|---|---|
| 1 | 216 | 114.5 | 18.3 |
| | | 1466.7 | 4.0 |
| | | 2099.8 | 2.9 |
| | | 3488.8 | 1.3 |
| 2 | 242 | 94.0 | 16.5 |
| | | 1342.4 | 2.4 |
| | | 2319.0 | 2.0 |
| | | 3242.6 | 1.1 |
| 3 | 267 | 547.2 | 311.0 |
| | | 1530.7 | 736.6 |
| | | 1860.0 | 719.7 |
| | | 3081.3 | 89.5 |
| 4 | 333 | 527.7 | 242.3 |
| | | 1376.2 | 358.7 |
| | | 1890.2 | 431.4 |
| | | 3124.2 | 89.6 |
| 5 | 286 | 320.2 | 646.9 |
| | | 1271.5 | 412.1 |
| | | 1955.2 | 365.2 |
| | | 3099.6 | 131.0 |
| 6 | 267 | 272.7 | 2014.6 |
| | | 1085.4 | 805.6 |
| | | 1867.2 | 494.2 |
| | | 2952.6 | 114.4 |
| 7 | 229 | 269.6 | 2228.0 |
| | | 1049.0 | 796.2 |
| | | 1891.9 | 540.4 |
| | | 2922.5 | 139.7 |
| 8 | 235 | 273.8 | 2417.7 |
| | | 925.8 | 619.5 |
| | | 1936.1 | 420.9 |
| | | 2926.9 | 145.5 |
| 9 | 229 | 242.1 | 1165.0 |
| | | 849.6 | 154.8 |
| | | 1977.0 | 116.0 |
| | | 2968.0 | 34.2 |
| 10 | 258 | 228.9 | 85.4 |
| | | 1085.0 | 6.8 |
| | | 2109.0 | 4.4 |
| | | 3267.2 | 2.1 |
| 11 | 308 | 115.2 | 16.9 |
| | | 1513.9 | 3.2 |
| | | 2314.5 | 4.7 |
| | | 3104.6 | 1.6 |
| 12 | 348 | 378.4 | 22.0 |
| | | 1542.1 | 38.5 |
| | | 2395.0 | 42.3 |
| | | 2987.4 | 28.8 |
| 13 | 320 | 328.1 | 675.1 |
| | | 1466.8 | 237.0 |
| | | 2359.4 | 265.3 |
| | | 2971.3 | 189.5 |
| 14 | 286 | 308.4 | 3161.6 |
| | | 936.7 | 376.6 |
| | | 2557.0 | 369.8 |
| | | 2962.7 | 318.3 |

-continued

| Time frame No. | $f_p$ [Hz] | $f_1$, $f_2$, $f_3$, $f_4$ [Hz] | $a_1$, $a_2$, $a_3$, $a_4$ |
|---|---|---|---|
| 15 | 296 | 314.1 | 3466.2 |
| | | 1157.5 | 404.6 |
| | | 2661.8 | 1121.6 |
| | | 3045.0 | 610.4 |
| 16 | 296 | 308.1 | 3466.3 |
| | | 1002.8 | 395.6 |
| | | 2642.5 | 761.4 |
| | | 2956.0 | 539.3 |
| 17 | 286 | 291.1 | 1970.8 |
| | | 787.6 | 323.7 |
| | | 2677.0 | 277.1 |
| | | 2960.2 | 344.9 |
| 18 | 258 | 258.0 | 548.3 |
| | | 582.1 | 91.8 |
| | | 2542.9 | 25.5 |
| | | 2947.6 | 32.4 |
| 19 | 250 | 247.1 | 49.5 |
| | | 980.0 | 3.3 |
| | | 2310.4 | 2.2 |
| | | 3233.5 | 1.5 |
| 20 | 250 | 163.5 | 9.2 |
| | | 1246.5 | 2.1 |
| | | 2287.4 | 1.3 |
| | | 3244.8 | 0.9 |

When run with the above mentioned numerical values, human voices pronouncing "kaki" were heard.

Figure 3:
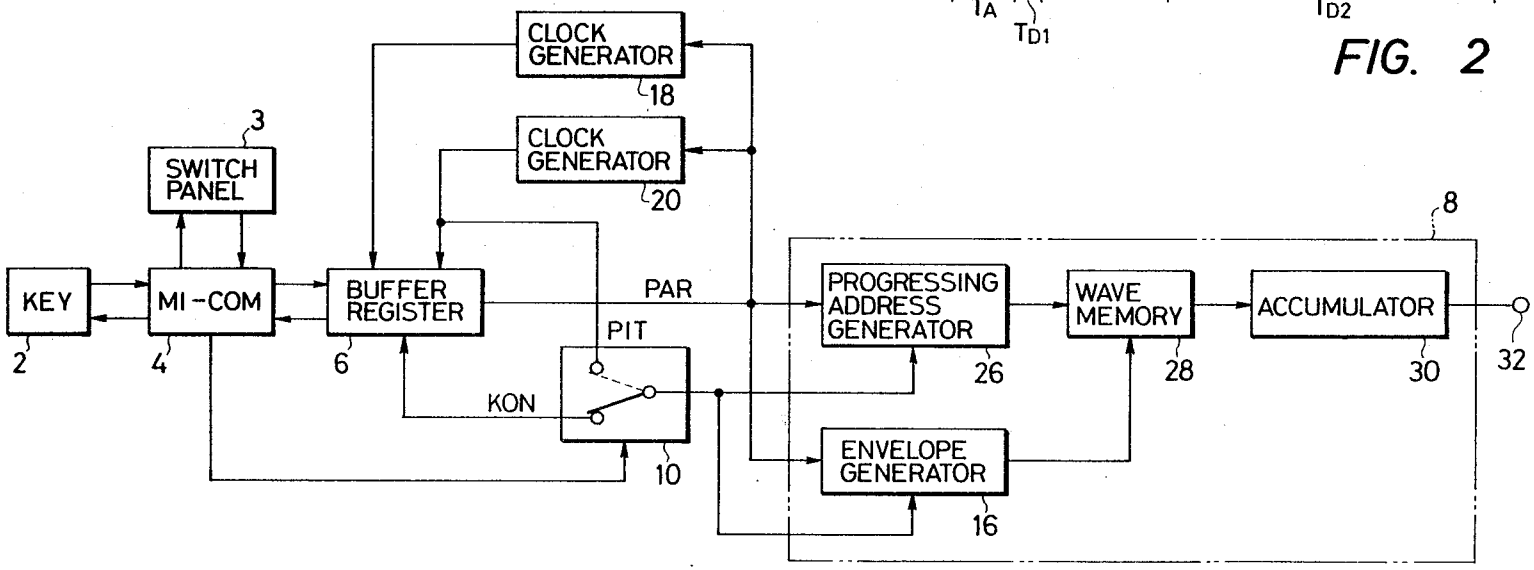
FIG. 3 is a block diagram showing another embodiment of the electronic musical instrument according to the present invention.

FIG. 3 shows another embodiment of the electronic musical instrument of the present invention. The same reference numerals are attached to the parts common to those in FIG. 1. The vibration wave generating means 8 provided in this embodiment is to use a set of circuits to generate a plurality of vibration waves by a time division operation. Here, a progressing address generation 26 generating phase angles, that is, progressing address signals in response to parameter signals PAR for respective time slots of a time division multiplex system and a vibrating wave memory 28 for reading out vibrating waves by the progressing address signals are provided. The envelope signals ENV from the envelope generators 16 are given to this wave memory circuitry 28 so that wave samples having desired envelope waves may be formed one after another. The wave samples of a plurality of time-division multiplexed tones are supplied to an accumulator 30 so as to be added together.

As understood from the above, the provision of the vibrating wave generating means may be in a parallel fashion as shown in FIG. 1 or may be in a time-division multiplexed fashion as shown in FIG. 3.

Figure 4:
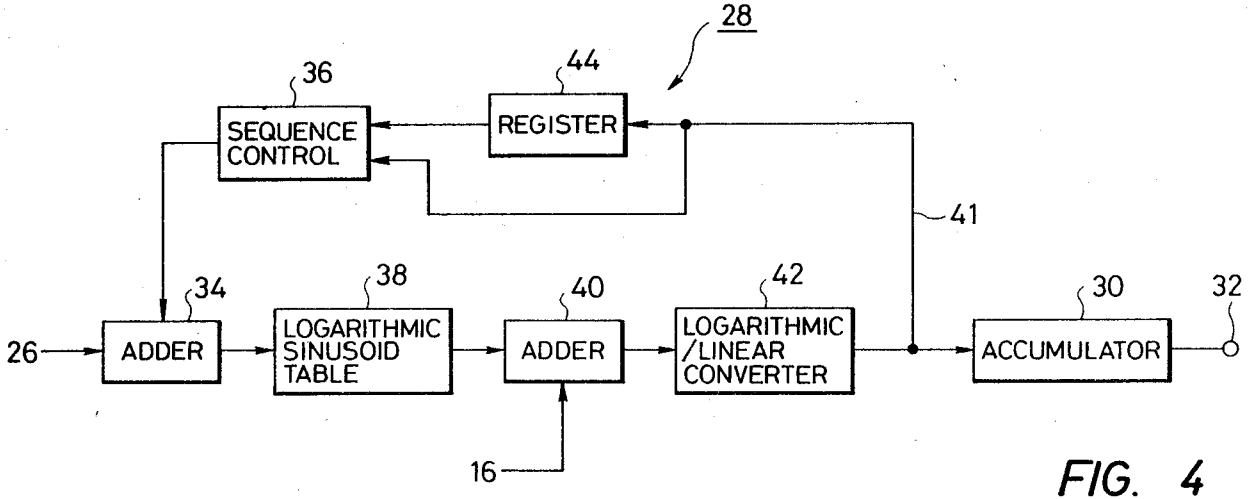
FIG. 4 is a block diagram showing a detailed construction of one example of the vibrating wave generator in the embodiment in FIG. 3.

FIG. 4 shows a detailed construction of a memory reading type vibrating wave generator used as the wave memory circuitry 28 in FIG. 3. The progressing address signals are applied to a logarithmic sinusoid table 38 which is a memory memorizing in logarithmic values the respective phase point samples of a sinusoid wave and is read out by the progressing address signals from the adder 34. The logarithmic sinusoid sample values delivered out of this logarithmic sinusoid table 38 are added with the envelope sample values (which are also made logarithmic values) in an adder 40 and the total values are converted to linear sample values in a logarithmic/linear converter 42.

In this vibrating wave generator, a feedback loop 41 is formed so that the sinusoid wave signals to which the envelopes have been inparted may be added to the progressing address signals for reading out the sinusoid table. Therefore, the logarithmic sinusoid table 38 will be read out by the while progressing address which reciprocates forward and rearwared to fluctuate and, as a result, frequency modulated (FM) signal waves will be generated. A sequence control circuit 36 is provided together with a register 44 in the feedback loop 41. The outputs of the register 44 and the outputs of the logarithmic/linear converter 42 not through the register 44 are directly given to this sequence control circuit 36. The sequence control circuit 36 is provided to control the caluculating manner by these connected circuits in accordance with the modes of FM operation at the time of generating musical tones and is rendered inoperative to perform no FM operation at the time of generating human voices.

As the above mentioned circuit construction generates a plurality of tones by the time division multiplexed operation, the outputs of the logarithmic/linear converter 42 are supplied one after another to the accumulator 30 and a signal wave added together for each sampling time point is formed by the accumulation and is taken out of the output terminal 32.

What is claimed is:

1. An electronic musical instrument comprising:

tone generation designating means generating in response to depression of playing keys a plurality of sets of parameter signals, each set per each key, designating the properties of tones to be generated respectively and a plurality of key-on signals each representing the depression of each key, vibrating wave generating means associated with said tone generation designating means and generating a plurality of vibrating wave signals having tone properties including frequencies designated by said respective parameter signals and having a wave shape starting from a predetermined initial phase point responsive to said respective key-on signals, a first clock pulse generator associated with said tone generation designating means and generating time frame clock pulses of a predetermined period defining consecutive time frames, a second clock pulse generator associated with said tone generation designating means and generating pitch clock pulses of predetermined periods for the respective time frames respectively defining fundamental pitches of human voice to be produced, and controlling means associated with said tone generation designating means and said vibrating wave generating means and controlling said tone generation designating means so as to generate for said respective time frames a plurality of parameter signals designating a plurality of frequencies corresponding to a plurality of formant frequencies of human voice to be produced and rendering said pitch clock pulses to be fed to said vibrating wave generating means in place of said key-on signals, said vibrating wave generating means thereby generating vibrating wave signals simulating human voices.

2. An electronic musical instrument according to claim 1 wherein said tone generation designating means is formed of a keyboard including keys, a switch panel, including control switches, a microcomputer and a buffer register so that, on the basis of the respective keys as depressed on said keyboard and the respective switches as operated on said switch panel, said microcomputer generates a plurality of sets of parameter signals designating the properties of respective tones to be generated and a plurality of key-on signals representing the respective depressed keys, delivers them out through said buffer register and controls said first and second clock pulse generators and said controlling means.

3. An electronic musical instrument according to claim 2 wherein said first clock pulse generator is controlled by said microcomputer to generate rhythm clock pulses for automatic rhythms at the time of music performance but to generate time frame clock pulses at the time of human voice simulation.

4. An electronic musical instrument according to claim 2 wherein said second clock pulse generator is controlled by said microcomputer to generate clock pulses for key scanning at the time of musical performance but to generate pitch clock pulses representing fundamental pitches of human voice at the time of human voice simulation.

5. An electronic musical instrument according to claim 1 wherein said vibrating wave generating means comprises a plurality of discrete wave generators connected in parallel and is so formed that each of said wave generators generate each vibrating wave signal as determined by each set of said parameter signals from said tone generation designating means.

6. An electronic musical instrument according to claim 1 wherein said vibrating wave generating means comprises one wave generator and an accumulator connected thereto and is so formed that said wave generator generates a plurality of vibrating wave signals one after another in a time division multiplex fashion on the basis of the respective sets of said parameter signals from said tone generation designating means, the time divisionally generated plurality of vibrating wave signals being accumulated by said accumulator so as to form a combined output wave signal.

7. An electronic musical instrument according to claim 6 wherein said vibrating wave generating means comprises:

a progressing address generator generating progressing address signals in response to the parameter signals for the respective time frames, an envelope generator generating envelope signals responsive to said parameter signals and either ones of the key-on signals and the pitch clock pulses and a wave memory circuitry delivering wave samples having desired envelopes on the basis of said progressing address signals and said envelope signals.

8. An electronic musical instrument according to claim 7 wherein said wave memory circuitry comprises:

a first adder, a logarithmic sinusoid table memory memorizing sinusoid sample values at respective phase point in logarithmic values and delivering out logarithmic sinusoid sample values in response to the progressing address signals inputted through said first adder, a second adder connected to said logarithmic sinusoid table memory and adding said logarithmic sinusoid sample values from said logarithmic sinusoid table memory and the envelope signals delivered out in logarithmic values from said envelope generator, a logarithmic/linear converter connected to said second adder and converting the outputs from said second adder to linear sample values, an accumulator connected to said logarithmic/linear converter and accumulating the linear sample values, and a feedback loop connected between said logarithmic/linear converter and said first adder so as to feed the outputs of said logarithmic/linear converter back to said first adder.

* * * * *